United States Patent [19]

Rottländer et al.

[11] Patent Number: 4,730,473

[45] Date of Patent: Mar. 15, 1988

[54] METHOD AND APPARATUS FOR ROLLING TUBES

[75] Inventors: Ulrich Rottländer, Overath; Gustav Thönes, Gummersbach, both of Fed. Rep. of Germany

[73] Assignee: L. & C. Steinmüller GmbH, Gummersbach, Fed. Rep. of Germany

[21] Appl. No.: 896,427

[22] Filed: Aug. 13, 1986

[30] Foreign Application Priority Data

Aug. 13, 1985 [DE] Fed. Rep. of Germany ..... 3528967

[51] Int. Cl.[4] ..... B21D 39/06

[52] U.S. Cl. ..... 72/16; 72/123

[58] Field of Search ..... 72/3, 16, 26, 122, 123; 29/705, 715, 727; 73/635, 637, 639, 597

[56] References Cited

U.S. PATENT DOCUMENTS

| | | | |
|---|---|---|---|
| 3,401,547 | 9/1968 | Hall et al. | 72/16 |
| 3,404,551 | 10/1968 | Spisak | 72/16 |
| 3,600,613 | 8/1971 | Clark | 73/637 |
| 3,693,387 | 9/1972 | Blackburn | 72/122 |
| 4,520,672 | 6/1985 | Saint-Amour | 73/637 |

FOREIGN PATENT DOCUMENTS

| | | | |
|---|---|---|---|
| 774715 | 10/1980 | U.S.S.R. | 29/727 |
| 923677 | 4/1982 | U.S.S.R. | 29/727 |

*Primary Examiner*—Lowell A. Larson

*Attorney, Agent, or Firm*—Becker and Becker, Inc.

[57] ABSTRACT

A method and apparatus for rolling tubes into tube plates, especially heat exchangers, with a tube roller. Prior to the rolling process, the desired holding expansion value is set, and during the rolling process the holding expansion is measured. When the preset expansion value is reached, the expansion is discontinued. The magnitude of the holding expansion is determined by ultrasonically measuring the changing thickness of the wall of the tube during the expansion. The apparatus includes a tube roller that is operated by a drive mechanism. Also provided is a roll controller that can be set to the desired holding expansion value. An ultrasonic measuring head is provided in the tube roller, and is connected with the roll controller.

7 Claims, 1 Drawing Figure

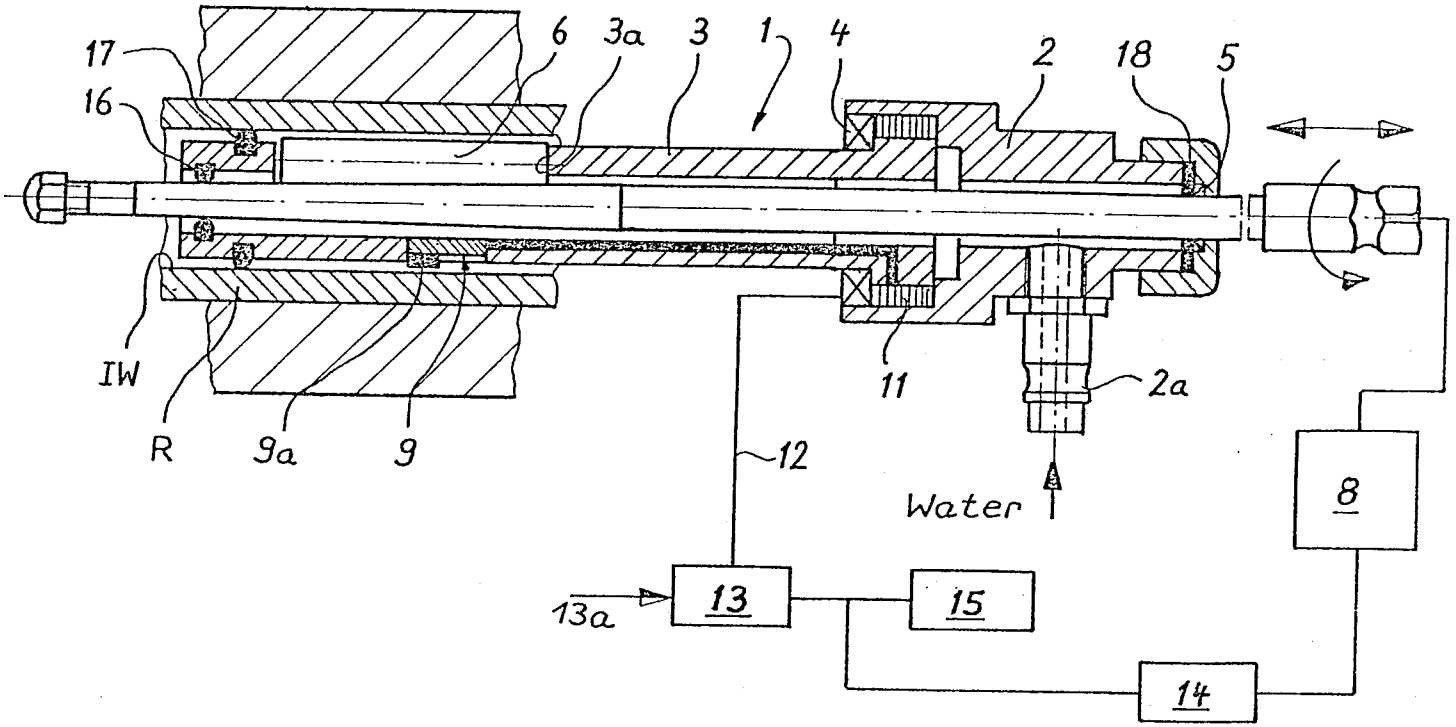
5
18
2
4
1
3
3a
6
17
16
2a
11
12
Water
8
14
15
13
13a
9
9a
R
IW

METHOD AND APPARATUS FOR ROLLING TUBES

BACKGROUND OF THE INVENTION

1. Field of the Invention

The present invention relates to a method and an apparatus for rolling tubes into tube plates, especially heat exchangers, with a tube roller that has expandable rollers.

2. Description of the Prior Art

With tube rollers, such as are known, for example, from U.S. Pat. No. 4,007,699—Clemens dated Feb. 15, 1977 as based on German Offenlegungsschrift No. 22 05 281 and German Offenlegungsschrift No. 23 31 341, the roll mandrel, which engages concentric rollers, is shifted in the direction toward the rollers until the required holding expansion is achieved. With the heretofore known methods, the holding expansion is measured as the torque that occurs at the drive motor, and when that set torque is achieved that corresponds to the desired holding expansion, at least the mandrel feed is switched off by the drive mechanism.

However, there was found that this indirect measurement of the holding expansion must be improved in order to achieve completely reproducible rolling results and even to avoid rerolling when the roll mandrel is in an axial state of rest.

An object of the present invention therefore is to provide a method and apparatus with which it is possible to more precisely detect when the desired holding expansion has been achieved.

BRIEF DESCRIPTION OF THE DRAWING

This object, and other objects and advantages of the present invention, will appear more clearly from the following specification in conjunction with the accompanying schematic drawing, which illustrates one exemplary inventive apparatus for practicing the method of the present invention.

SUMMARY OF THE INVENTION

The method of the present invention includes the steps of: First setting the desired holding expansion value; rolling a tube; determining the magnitude of the holding expansion during the rolling step by ultrasonically measuring the changing thickness of the wall of the tube during the expansion; and discontinuing expansion when the set holding expansion value is reached.

Thus, a direct measurement of the holding expansion is possible pursuant to the inventive method.

The present invention is also directed to an apparatus for carrying out this method. In particular, the inventive apparatus comprises: a tube roller having expandable rollers; a drive mechanism for operating the tube roller; a roll controller that can be set to the desired holding expansion value; and an ultrasonic measuring head that is provided in the tube roller and is connected with the roll controller. The ultrasonic measuring head is preferably oriented essentially at right angles to the axis of rotation of the tube roller. The measuring arrangement is primarily such that ultrasonic field components penetrate the wall of the tube. Mirror arrangements can also be interposed.

The inventive apparatus preferably includes a tube roller of the general type described in U.S. Pat. No. 4,007,699—Clemens based on German Offenlegungsschrift Nos. 22 05 281 and 23 31 341, or in German Offenlegungsschrift No. 29 24 835. Such a tube roller has at least several coaxial rollers that are disposed in a rotatable roller body, and a conical roll mandrel that is displaceable at least axially for expanding or spreading apart the rollers. The contents of the aforementioned references are hereby incorporated into the present application by this reference thereto.

In this preferred embodiment of the inventive apparatus, the ultrasonic measuring head is expediently disposed in the roller body.

It is furthermore expedient to connect the ultrasonic measuring head with the roll controller via a slip-ring connection.

To couple the measuring window of the ultrasonic measuring head to the inner wall of the tube, it is expedient to fill the free space between the measuring window and the inner wall of the tube with a fluid. This fluid can also at the same time withdraw the heat that is released during the rolling process if the annular space, rather than being statically filled with the coupling fluid, which is preferably water, has the water flowing therethrough.

With the apparatus of German Offenlegungsschrift No. 23 31 341 the axial feed of the roll mandrel can be separate from a rotational movement in order, when the greatest torque has been achieved, to still enable a smooth rolling of the inner wall of the tube when the roll mandrel has been fixed in its axial position; in contrast, with the inventive method, the feed and the rotation of the roll mandrel are rigidly coupled with one another, since a direct measurement of the thickness of the wall is effected. It is therefore no longer necessary to separate the feed movement and the rotational movement. The rotational movement of the roll mandrel is transmitted to the roller body via the rollers. It is therefore preferable that the roll mandrel and the roller body, without being coupled, be in rotational engagement with one another via the rollers.

Further specific features of the present invention will be described in detail subsequently.

DESCRIPTION OF PREFERRED EMBODIMENTS

Referring now to the drawing in detail, the tube roller 1 has a base part 2 in which a roller body 3 is rotatably mounted via bearings 4 and 5.

Three rollers 6 are concentrically mounted in appropriate slots or grooves 3*a* of the roller body 3. Displaceably disposed in line with the central axis of the roller body 3 and of the base part 2 is a roll mandrel 7 that is conical toward the front. The rollers 6 can be spread apart by means of the mandrel 7. The geometry of the rollers 6 conforms to the taper of the mandrel 7.

The roll mandrel 7 is operatively associated with a drive mechanism 8 that can displace and rotate the mandrel. By arranging the rollers 6 in the grooves 3*a*, and by placing these rollers on the surface of the mandrel 7, a rotational movement is transmitted to the roller body 3.

Disposed in the roller body, between the grooves 3*a* that are provided at 120° intervals, is an ultrasonic measuring head 9, the measuring window 9*a* of which is oriented radially toward the inner wall IW of a tube R that is tube rolled into a tube plate.

The ultrasonic measuring head 9 is connected via lines 10 with a slip-ring mechanism 11. On the output side, the slip-ring mechanism 11, in the base part 2, is connected via a line 12 with a roll controller 13 which is supplied with the holding expansion value that is to be achieved via a desired-value regulator 13*a*. The roll controller 13 can control a switching mechanism 14 which, in turn, can turn the drive mechanism 8 on or off. Furthermore, the progress of the spreading or expansion can be monitored or recorded by a gauge and/or recording device 15.

The base part 2 is provided with a water line 2*a* so that the gap or annular space between the mandrel 7 and the roller body 3 can be filled with water. Via the grooves 3*a*, this water also fills the annular space between the outer surface of the roller body and the inner wall IW of the tube. Sealing means are required to prevent the water from leaking out. Representative of such sealing means are the two O-ring seals 16 and 17 illustrated in FIG. 1. One skilled in the art is readily in the position to provide appropriate seals, such as the seal 18, in the region of the base part 2 or anywhere else where desired. For the sake of simplicity, not all of these seals have been illustrated.

The supply of water can be effected statically, so that no flow-through occurs, or the water can flow, so that the heat generated during the rolling can also be withdrawn via the coupling fluid.

The pulses associated with the striking of the ultrasonic field on the inner wall IW of the tube and on the tube plate can be discriminated from one another, so that it is possible to continuously measure the thickness. Ultrasonic measuring processes for determining thickness are in themselves known.

The present invention is, of course, in no way restricted to the specific disclosure of the specification and drawing, but also encompasses any modifications within the scope of the appended claims.

What we claim is:

1. A method of rolling tubes into tube plates with a tube roller having expandable rollers, said method including the steps of:

first setting a desired holding expansion value;

rolling a tube;

determining the magnitude of the holding expansion during said rolling step by ultrasonically measuring the changing thickness of the wall of said tube during the expansion;

comparing the actual holding expansion value with the desired holding expansion value; and upon reading said desired holding expansion value, discontinuing expansion when said desired holding expansion value is reached.

2. An apparatus for rolling tubes into tube plates, comprising:

a tube roller having expandable rollers;

a drive mechanism for operating said tube roller;

a roll controller that can be set to a desired holding expansion value;

an ultrasonic measuring head provided in said tube roller and connected with said roll controller so that an actual holding expansion value is derived from an output signed of said ultrasonic measuring head; and means to compare and determine when the actual expansion value reaches or equals the desired expansion value to stop the roller drive mechanism.

3. An apparatus according to claim 2, in which said tube roller includes a rotatable roller body in which are disposed at least several concentric ones of said rollers, and a conical roll mandrel that can be displaced at least axially for spreading or expanding said rollers; and in which said ulrasonic measuring head is disposed in said roller body.

4. An apparatus according to claim 3, in which said ultrasonic measuring head is connected with said roll controller via a slip-ring mechanism.

5. An apparatus according to claim 3, in which said ultrasonic measuring head is provided with a measuring window, with a free space being provided between the latter and the inner wall of said tube, and being filled with a fluid.

6. An apparatus according to claim 3, in which said roll mandrel and said roller body, without a direct coupling arrangement, are in rotational engagement with one another via said rollers.

7. An apparatus according to claim 3, in which said ultrasonic measuring head is oriented at essentially right angles to the axes of rotation of said rollers.

* * * * *